US009981728B2

(12) United States Patent
Woodruff

(10) Patent No.: US 9,981,728 B2
(45) Date of Patent: May 29, 2018

(54) PUMP JET WITH EXHAUST DIVERTER

(71) Applicant: RAIDER OUTBOARDS, INC., Titusville, FL (US)

(72) Inventor: Christopher Woodruff, Palmetto, FL (US)

(73) Assignee: RAIDER OUTBOARDS, INC., Titusville, FL (US)

( * ) Notice: Subject to any disclaimer, the term of this patent is extended or adjusted under 35 U.S.C. 154(b) by 0 days. days.

(21) Appl. No.: 15/401,700

(22) Filed: Jan. 9, 2017

(65) Prior Publication Data

US 2017/0197696 A1 Jul. 13, 2017

Related U.S. Application Data

(60) Provisional application No. 62/276,609, filed on Jan. 8, 2016.

(51) Int. Cl.

| | |
|---|---|
| ***B63H 11/00*** | (2006.01) |
| ***B63H 20/26*** | (2006.01) |
| ***B63H 11/08*** | (2006.01) |
| ***B63H 1/14*** | (2006.01) |

(52) U.S. Cl.

CPC ..... *B63H 20/26* (2013.01); *B63H 1/14* (2013.01); *B63H 11/08* (2013.01); *B63H 2011/081* (2013.01)

(58) Field of Classification Search

CPC ..... B63H 20/26; B63H 1/14; B63H 11/08

See application file for complete search history.

(56) References Cited

U.S. PATENT DOCUMENTS

| | | | | |
|---|---|---|---|---|
| 4,023,353 A | | 5/1977 | Hall | |
| 4,931,026 A | * | 6/1990 | Woodland | B63H 20/245 416/193 R |
| 5,273,467 A | | 12/1993 | Hall | |
| 5,325,662 A | * | 7/1994 | Varney | B63H 11/14 416/93 A |
| 6,190,218 B1 | * | 2/2001 | Hall | B63H 1/16 440/67 |

* cited by examiner

*Primary Examiner* — Stephen P Avila

(74) *Attorney, Agent, or Firm* — Mannava & Kang, P.C.; Eliot R. Malamud

(57) ABSTRACT

A pump jet apparatus for a motor includes an annular exhaust channel to receive exhaust gas from the motor. At least one hollow exhaust vane extends radially from a vane hub surrounding the annular exhaust channel. The at least one hollow exhaust vane is in flow communication with the annular exhaust channel to discharge the exhaust gas received from the motor through an exhaust discharge outlet. An impeller driven by the motor is mounted rearward of the annular exhaust channel and the at least one hollow exhaust vane and exhaust outlet.

16 Claims, 5 Drawing Sheets

(Conventional Through-the-Hub Motor with Propeller)

PUMP JET WITH EXHAUST DIVERTER

CLAIM FOR PRIORITY

The present Application for Patent claims priority to U.S. Provisional Application No. 62/276,609 filed Jan. 8, 2016, assigned to the assignee hereof and hereby expressly incorporated by reference herein.

TECHNICAL FIELD

The disclosed embodiments relates generally to an apparatus for directing the discharge of exhaust gases through vanes in the housing of a pump jet for a marine outboard motor.

BACKGROUND

A boat propulsion system using an outboard motor generally includes a propeller driven by a powerhead to propel the boat through the water. A type of outboard motor that discharges exhaust through the propeller is referred to as an exhaust-through-the-hub motor.

In an outboard motor that includes a pump jet system, an axial-flow pump jet system is driven by a powerhead of an engine. An impeller or rotor is mounted (e.g., spline fitted) directly on the propeller output shaft in place of the propeller and is encased within a housing. Such a system has the advantages of reducing hazards to swimmers in the vicinity of the motor, protecting the rotating elements from interference with and damage by foreign objects in the water, and improving the efficiency and performance of the propulsion system. Another benefit inherent with the pump jet is a directed jet of water that results in greater steering response.

BRIEF DESCRIPTION OF THE DRAWINGS

The embodiments are described in detail in the following description with reference to the following figures. The figures illustrate examples of the embodiments.

DETAILED DESCRIPTION

For simplicity and illustrative purposes, the principles of the embodiments are described by referring mainly to examples thereof. In the following description, numerous specific details are set forth in order to provide a thorough understanding of the embodiments. It is apparent that the embodiments may be practiced without limitation to all the specific details.

Figure 1:
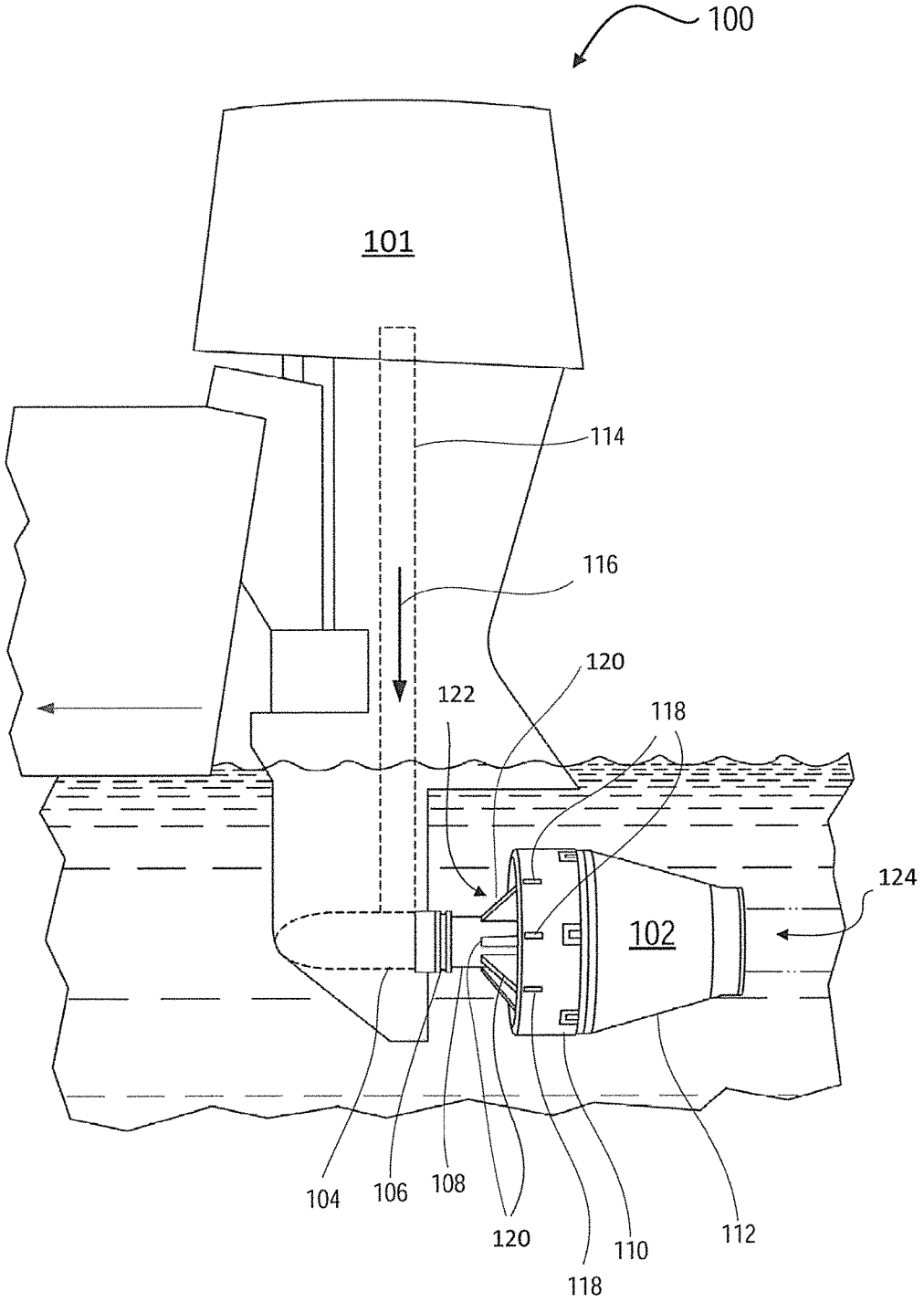
FIG. 1 depicts an exhaust-through-the-hub motor that includes a pump jet according to an example.

FIG. 1 generally depicts an exhaust-through-the-hub outboard motor 100 that includes a pump jet 102 mounted to a gear case 104 of the motor 100. The terms "forward" and "rearward" used throughout this specification refer to a relative position of a particular element relative to a water inlet side 122 (an upstream side) and a water outlet side 124 (a downstream side), of the pump jet 102 in a forward operating mode in which the motor 100 propels a boat in a forward, i.e., upstream, direction.

Exhaust gas 116 generated by powerhead 101 is ducted downwardly through a motor exhaust duct 114 and exits through a gear case 104. In examples disclosed herein, pump jet 102 includes a flange 106 through which pump jet 102 is mounted to the gear case 104.

Pump jet 102 includes a rotor hub 108, a rotor housing 110 surrounding a rearward portion of rotor hub 108, and a stator housing 112.

Rotor hub 108 receives exhaust gas 116 exiting the motor 100 through gear case 104. Exhaust gas 116 is discharged from pump jet 102 through at least one hollow exhaust vane 120 in flow communication with a respective exhaust outlet 118 that penetrates an outer surface of rotor housing 110 forward of the stator housing 112.

Figure 2:
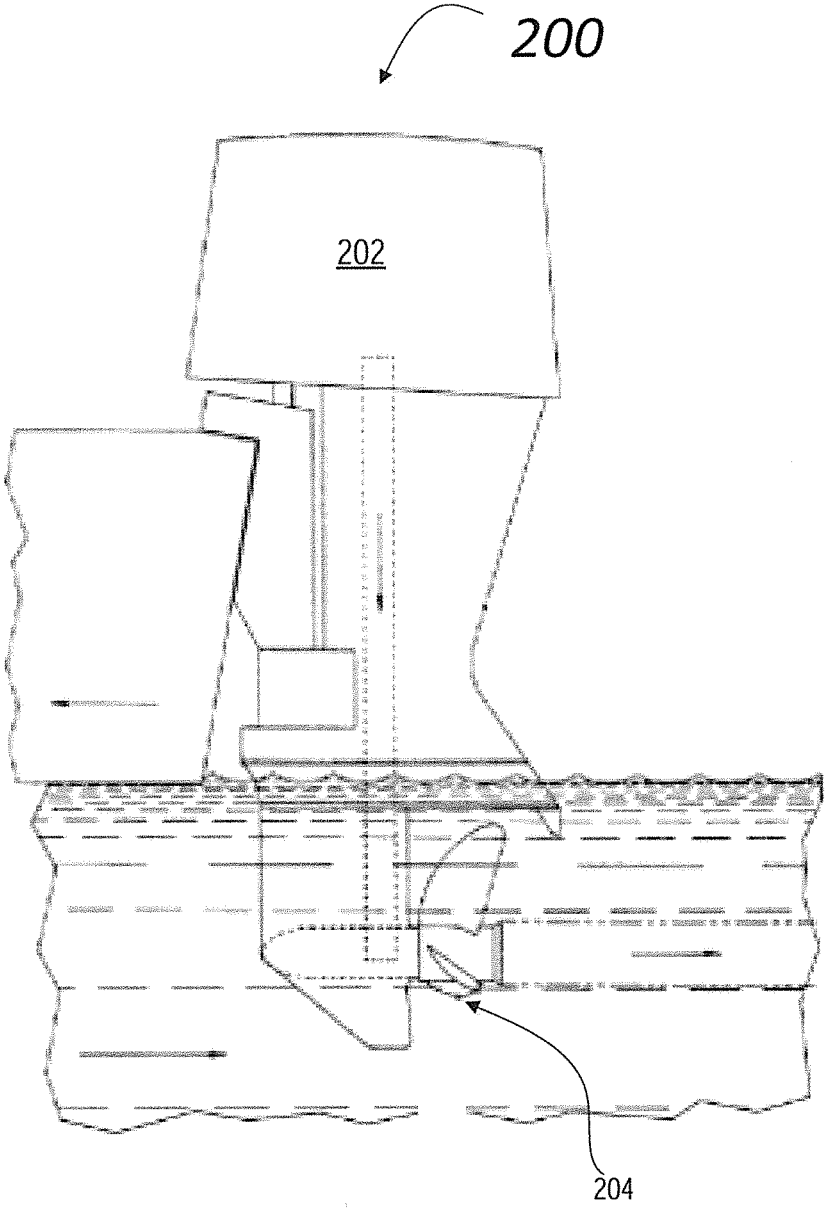
FIG. 2 depicts an exhaust-through-the-hub motor with a propeller.

FIG. 2 depicts a boat propulsion system using an exhaust-through-the-hub motor 200 and includes an unhoused propeller 204 driven by a powerhead 202 to propel the boat through the water. The exhaust exits rearward of the motor 200 through the propeller 204.

Figure 3:
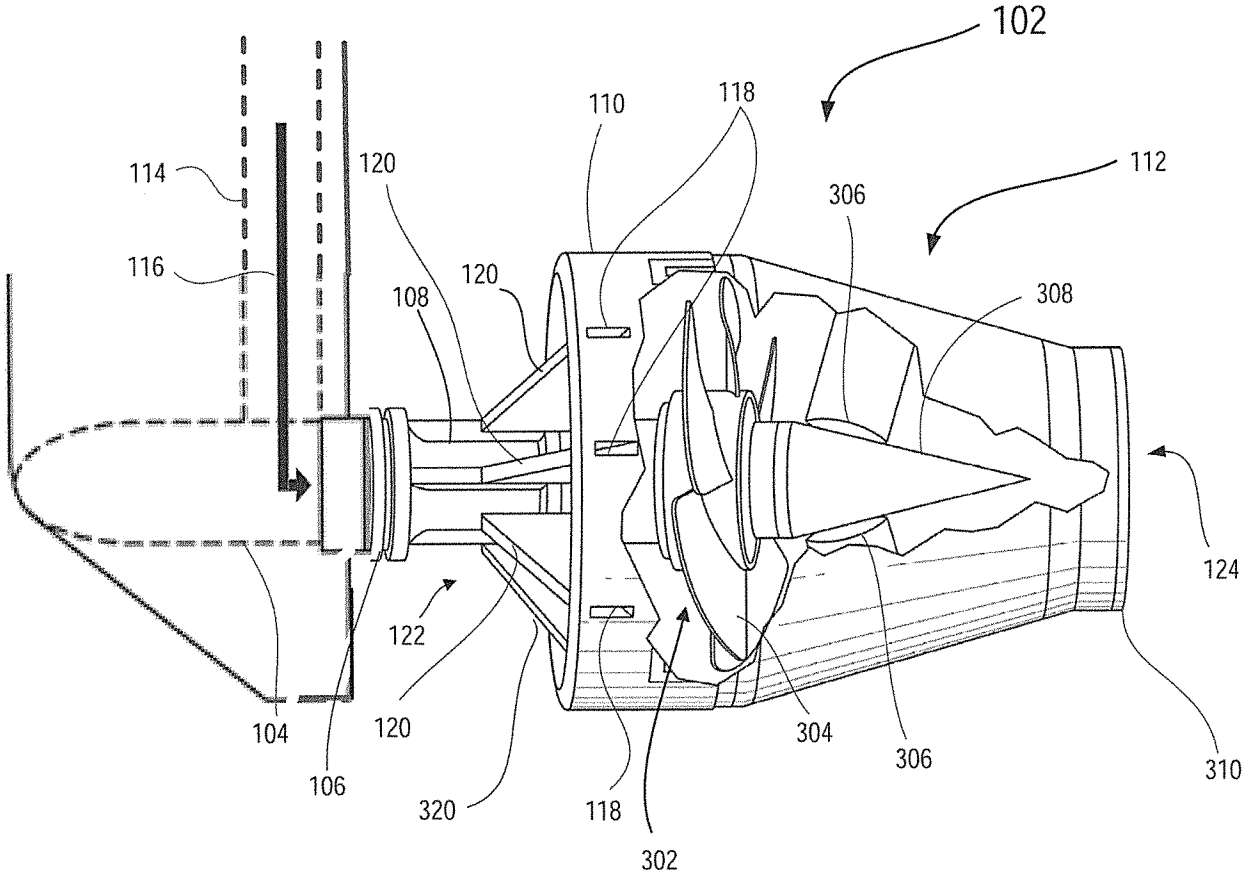
FIG. 3 depicts a pump jet according to an example.

FIG. 3 depicts an enlarged side view of the pump jet 102 shown in FIG. 1. As an example, rotor housing 110 includes an impeller 302 mounted rearward of hollow exhaust vanes 120 and exhaust outlets 118. Impeller 302 includes blades 304 that force an intake of water to flow from the inlet side 122 through the rotor housing 110 and the stator housing 112 to the outlet side 124 at nozzle 310. In an example, rotor housing 110 includes six hollow exhaust vanes 120 that discharge exhaust gas 116 into the water through respective exhaust outlets 118. In the example shown in FIG. 3, three hollow exhaust vanes 120 and three exhaust outlets 118 disposed on each of the right and left sides of the rotor housing 110.

The exhaust gas 116 from the powerhead 101 flows downwardly through the motor exhaust duct 114. The lower end of the motor exhaust duct 114 is in flow communication with a hub exhaust channel 402 (see FIG. 4), which channels the exhaust stream rearward through the rotor hub 108. The exhaust stream flows from the hub exhaust channel 402 into the at least one hollow exhaust vane 120, which is in flow communication with the hub exhaust channel 402. The exhaust stream in each hollow exhaust vane 120 flows the length of the hollow exhaust vane 120 and discharges through a respective exhaust outlet 118 into the water stream surrounding the rotor housing 110.

The rearward portion of the stator housing 112 discharges the water propelled rearward by the blades 304 at the outlet side 124 through the nozzle 310. The stator housing 112 has an upstream edge which form fits with a downstream edge of the rotor housing 110. The stator housing 112 has a generally conical portion which decreases in internal diameter in the downstream direction. The minimum internal diameter of stator housing 112 is located at the outlet 314.

In an example, the stator housing 112 is mounted to the rotor housing 110 with screws (not shown) and includes stators 306 that extend radially inward from the inner surface of the stator housing 112 towards a cone 308 that rotates with the impeller 302. The stators 306 convert rotational energy imparted to the water flow above the blades 304 into axial flow energy as the water exits through nozzle 310. Cone 308 is mounted to the rear side the impeller 302 and controls the water flow through the stator housing 112. Motor performance may be tuned by adjusting a length of the cone 308 within the stator housing 112.

Figure 4:
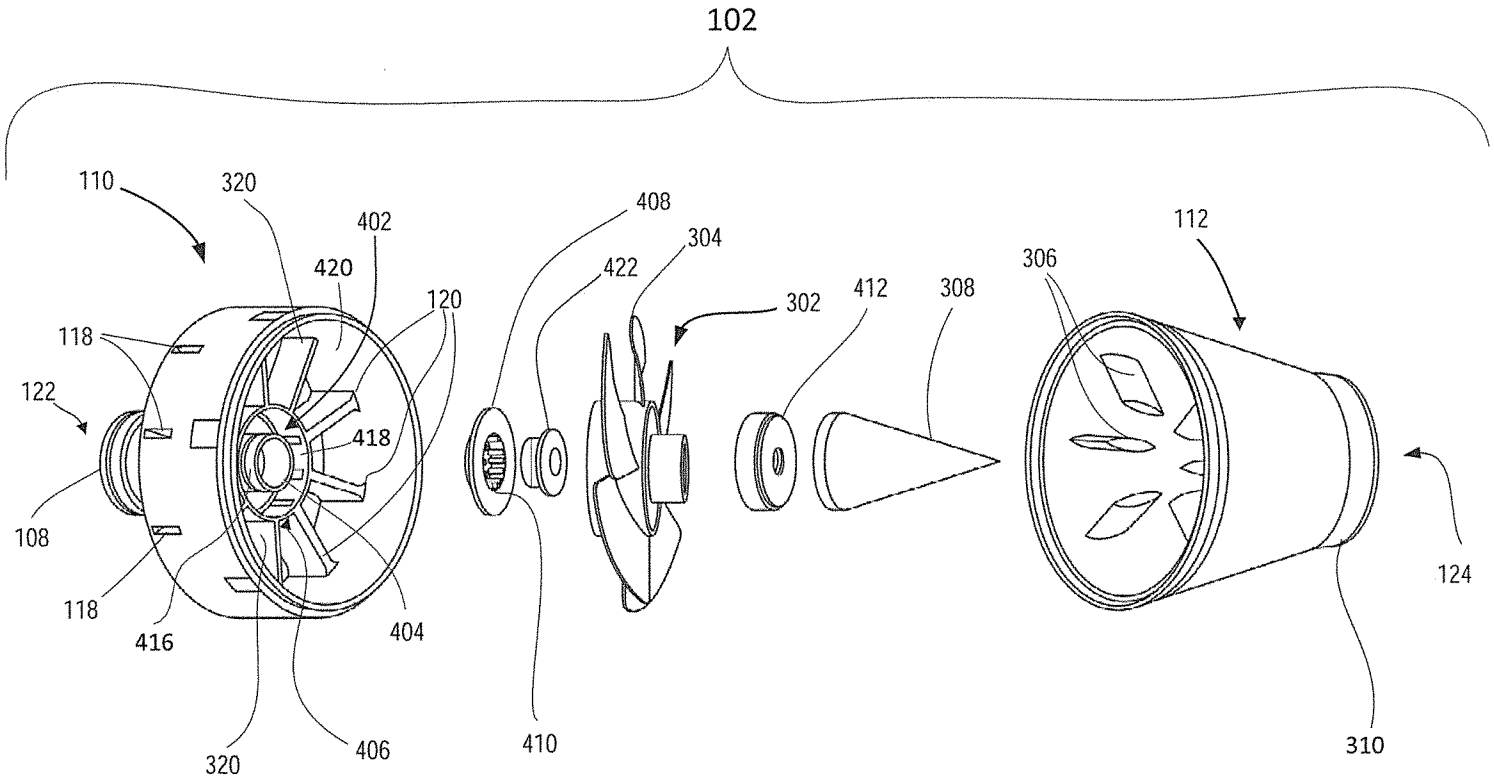
FIG. 4 is an exploded view of a pump jet according to an example.

FIG. 4 depicts an exploded view of pump jet 102 according to an example. Rotor hub 108 includes a propeller shaft housing 404 and a vane hub 406 surrounding the propeller shaft housing 404. The hub exhaust channel 402 is bounded internally by an outer wall 416 of the propeller shaft housing 404, an inner wall 418 of the vane hub 406, and an exhaust cap 408. The hub exhaust channel 402 is bound externally by a wall of the gear case 104.

The non-exhaust vanes 320 and hollow exhaust vanes 120 extend radially outward from the vane hub 406 to an inside wall 420 of rotor housing 110 and direct water flow through the blades 304 of impeller 302. In an example, at least one of the non-exhaust vanes 320 and hollow exhaust vanes 120 extend in a forward direction into the upstream water stream at the inlet side 122 to block foreign objects from entering the pump jet 102 and possibly interfering with impeller 302.

The hollow exhaust vanes 120 are in flow communication with hub exhaust channel 402. The exhaust cap 408 is disposed forward of impeller 302 and seals off the rearward end of the hub exhaust duct 114, forcing the exhaust gas 116 to exit the rotor housing 110 upstream of the impeller 302. The exhaust gas 116 exits through the hollow exhaust vanes 120 and respective exhaust outlets 118 in flow communication with the hub exhaust duct 114.

As described above, the hub exhaust channel 402 is bounded by the exhaust cap 408 forward of the impeller 302. The exhaust cap 408 is an annulus through which a propeller shaft extending from gear box 104 passes through towards the impeller 302. In an example, exhaust cap 408 is mounted by screws (not shown) to the rotor housing 110 and may include a centrally located propeller shaft bearing 410 to support the propeller shaft. In another example, exhaust cap 408 does not include propeller shaft bearing 410.

Impeller 302 is axially offset from exhaust cap 408 by a bushing 422. Bushing 422 is form fitted over the propeller shaft and when seated, abuts a shoulder (not shown) disposed on the propeller shaft. When mounted to the propeller shaft, the impeller 302 abuts the bushing 422 and stands off from the exhaust cap 408, which is non-rotatable. As such, the impeller 302 is free to rotate, being rearward of, and not in contact with, the exhaust cap 408. The motor 100 rotates the propeller shaft causing blades 304 to spin, thereby imparting energy and momentum to a water flow entering through the inlet 122 of rotor housing 110 and exiting through the outlet 124 at nozzle 310.

The exhaust cap 408 operates to discharge exhaust gas 116 forward of the impeller 302. The impeller 302 is mounted rearward of the exhaust cap 408 and prevents exhaust gas 116 from mixing with the water flowing through the impeller 302 and passing through stator housing 112. Furthermore, exhaust outlets 118 penetrate the outer surface of the rotor housing 110 forward of the stator housing 112 minimizing any exhaust gas 116 discharged from exhaust outlets 118 from being sucked into the pump jet 102 at nozzle 310 during a reverse operation of the motor 100.

The hub exhaust channel 402, the hollow exhaust vanes 120, and the exhaust outlets 118 are sized to maximize performance of the motor 100.

During conversion of an exhaust-through-the-hub outboard motor 200 with a propeller 204 to motor 100 with pump jet 102, propeller 204 is removed. The rotor housing 110, including exhaust cap 408, is mounted to gear case 104. Bushing 422 and impeller 302, with blades 304, are then inserted onto the propeller shaft. The impeller 302 is secured to the propeller shaft by a nut 412. Nut 412 is a threaded annulus that functions as a mounting plate for cone 308. Cone 308 is mounted to a surface of the nut 412 with screws (not shown) and rotates with the impeller 302.

Figure 5:
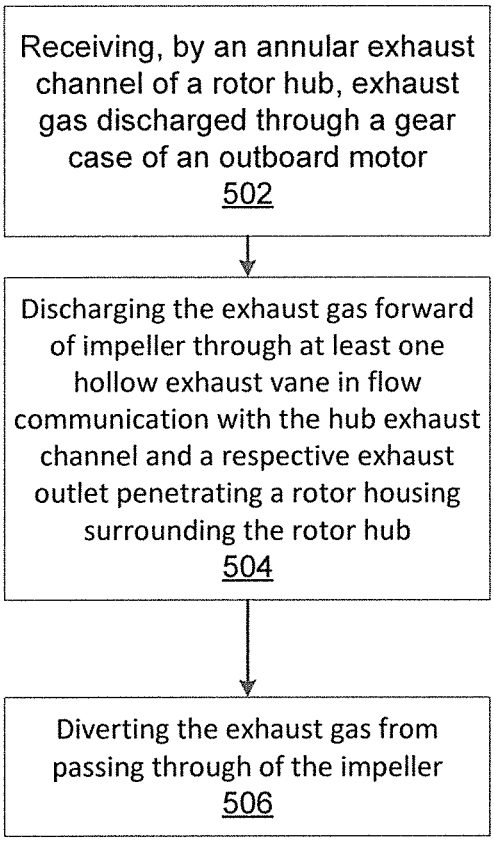
FIG. 5 depicts a method of diverting exhaust in an outboard motor according to an example.

FIG. 5 depicts an exemplary method of diverting exhaust gas 116 in the pump jet 102. At step 502, receiving, by the hub exhaust channel 402, the exhaust gas 116 discharged through the gear case 104 of the motor 100. Step 504 includes discharging the exhaust gas 116 forward of impeller through at least one hollow exhaust vane 120 in flow communication with the hub exhaust channel 402 and a respective exhaust outlet 118 penetrating the rotor housing 110 surrounding the rotor hub 108. As such, at step 506, the operation of the pump jet 102 causes the diverting of the exhaust gas from passing through the impeller 302.

Although elements of the described embodiments may be described or claimed in the singular, the plural is contemplated unless limitation to the singular is explicitly stated.

What is claimed is:

1. A pump jet apparatus for a motor, comprising:
a rotor housing, including:
an annular exhaust channel to receive exhaust from the motor;
a vane hub surrounding the annular exhaust channel; and
at least one hollow exhaust vane extending radially from the vane hub, the at least one hollow exhaust vane in flow communication with the annular exhaust channel, wherein each of the at least one hollow exhaust vane terminates at an exhaust outlet disposed on an outside surface of the rotor housing;
an impeller disposed rearward of the annular exhaust channel and the at least one hollow exhaust vane; and
a stator housing mounted to the rotor housing rearward of the impeller, wherein the exhaust received from the motor is discharged forward of the impeller through the at least one hollow exhaust vane and exhaust outlet.

2. The pump jet apparatus according to claim 1, wherein the annular exhaust channel is bounded internally by a propeller shaft housing, an inner surface of the vane hub, and an exhaust cap abutting the annular exhaust channel.

3. The pump jet apparatus according to claim 1 wherein the at least one hollow exhaust vane comprises three hollow exhaust vanes in flow communication with three exhaust gas outlets disposed on a left side of the rotor housing and three hollow exhaust vanes in flow communication with three exhaust gas outlets disposed on a right side of the rotor housing.

4. The pump jet apparatus according to claim 2, comprising a bushing offsetting the impeller from the exhaust cap.

5. The pump jet apparatus according to claim 4, wherein the exhaust cap is an annulus abutting a rearward end of the annular exhaust channel and the bushing is seated within the annulus.

6. The pump jet apparatus according to claim 5, wherein the impeller is secured by a threaded plate, and wherein a cone is mounted to the threaded plate and is rotatable with the impeller.

7. The pump jet apparatus according to claim 6, wherein the stator housing includes a plurality of stators extending inward from a surface of the stator housing towards the cone.

8. The pump jet apparatus according to claim 1, wherein the motor is a marine outboard motor.

9. A marine outboard motor comprising:
a powerhead; and
a pump jet apparatus, the pump jet apparatus comprising:
a rotor hub having an annular exhaust channel for receiving exhaust from the powerhead;
a rotor housing surrounding a rearward portion of the rotor hub;

a hollow member in flow communication with the annular exhaust channel and having an exhaust outlet penetrating the rotor housing; and an impeller positioned within the rotor housing rearward of the annular exhaust channel, wherein the impeller is secured by a threaded plate, and wherein a cone is mounted to the threaded plate and is rotatable with the impeller.

10. The marine outboard motor as recited in claim 9, wherein said hollow member comprises an exhaust vane extending forward of the rotor housing.

11. The marine outboard motor according to claim 9, further comprising a stator housing mounted to the rotor housing rearward of the impeller, the stator housing including a plurality of stators extending inward from a surface of the stator housing towards the cone.

12. A marine outboard motor comprising:

a powerhead; and a pump jet apparatus, the pump jet apparatus comprising:

a rotor hub having an annular exhaust channel for receiving exhaust from the powerhead;

a rotor housing surrounding a rearward portion of the rotor hub;

a hollow member in flow communication with the annular exhaust channel and having an exhaust outlet penetrating the rotor housing; and an impeller positioned within the rotor housing rearward of the annular exhaust channel, wherein the annular exhaust channel is bounded by an exhaust cap abutting the annular exhaust channel forward of the impeller.

13. The marine outboard motor according to claim 12, wherein the exhaust cap is an annulus abutting a rearward end of the rotor hub to allow a propeller shaft to pass there through.

14. The marine outboard motor according to claim 9, wherein the hollow member and exhaust outlet are disposed forward of the impeller.

15. A method of diverting exhaust gas in an outboard motor, comprising:

receiving, by a hub exhaust channel of a rotor hub, the exhaust gas discharged through a gear case of the outboard motor; and discharging the exhaust gas forward of an impeller through at least one hollow exhaust vane in flow communication with the hub exhaust channel and a respective exhaust outlet penetrating a housing of the rotor hub, whereby the exhaust gas is diverting from passing through an impeller mounted rearward of the hub exhaust channel by an exhaust cap abutting the hub exhaust channel forward of the impeller.

16. The marine outboard motor according to claim 12, wherein the hollow member and the exhaust outlet are disposed forward of the impeller.

* * * * *